United States Patent [19]

van den Broek et al.

[11] 4,074,167

[45] Feb. 14, 1978

[54] HALOGEN INCANDESCENT LAMP

[75] Inventors: Cornelis Pieter van den Broek; Johannes Maria Josephus van Lieshout, both of Eindhoven, Netherlands

[73] Assignee: U. S. Philips Corporation, New York, N.Y.

[21] Appl. No.: 742,343

[22] Filed: Nov. 16, 1976

[30] Foreign Application Priority Data

Nov. 18, 1975 Netherlands ..... 7513429

[51] Int. Cl.[2] ..... H01J 5/50

[52] U.S. Cl. ..... 313/222; 174/50.61; 313/331

[58] Field of Search ..... 313/222, 331; 174/50.61

[56] References Cited

FOREIGN PATENT DOCUMENTS 933,577 9/1973 Canada ..... 313/222

*Primary Examiner*—Rudolph V. Rolinec
*Assistant Examiner*—Darwin R. Hostetter
*Attorney, Agent, or Firm*—Frank R. Trifari; Robert S. Smith

[57] ABSTRACT

Halogen incandescent lamps having at least two filaments are provided with a hard-glass lamp vessel. In the vacuum-tight seal of the vessel molybdenum wire current leadthrough conductors are incorporated which form one assembly with internal and external current conductors. In spite of large differences between the coefficients of expansion of the glass and the molybdenum, the lacking of rotationally symmetric geometry at the area of the current leadthroughs and the high thermal load of the lamp vessel seal, the lamps have proved to be very reliable.

5 Claims, 2 Drawing Figures

HALOGEN INCANDESCENT LAMP

The invention relates to a halogen incandescent lamp having a lamp vessel of a high-melting-point transparent material which is resistant to halogen, in which at least two tungsten filaments are stretched between at least three internal current conductors of molybdenum. The lamp vessel has a vacuum-tight seal in which current leadthrough conductors are incorporated which are each in electrical contact with one of the internal current conductors and with an external current conductor extending outside the lamp vessel, said lamp vessel being filled with a halogen-containing inert gas.

Such lamps are known inter alia from German Offenlegungsschrift No. 2,113,288 and they may be used, for example, as motorcar headlights. In the known lamps the lamp vessel consists of quartz glass or of types of glass having an $SiO_2$ content of more than 96%. Although there are expensive materials, one is nevertheless restricted to them because a halogen lamp requires a lamp vessel which can withstand both high temperatures and halogen.

Besides their high cost-price, the glasses used have the drawback that no high-melting-point metals are available which have such a low coefficient of expansion as said glasses. In order nevertheless to be able to lead current conductors in a vacuum-tight manner through the wall of a lamp vessel of such a glass, one has been compelled to use molybdenum foils which are incorporated in the pinch seal and which, in spite of the large difference between the coefficient of expansion of molybdenum and of the glass, enable a vacuum-tight seal due to their shape and due to the ductility of molybdenum.

However, the use of molybdenum foils involves that for a lamp having two filaments six connections have to be made to connect the foils at one end to internal current conductors and at the other end to external current conductors. These welded joints must be checked for reliability prior to sealing the filament assembly in the lamp vessel. The making and checking of the welded joints, the manufacture and the supply to the welding machine of the components to be welded likewise constitute important cost price-raising factors.

It is an object of the invention to provide halogen incandescent lamps which can be manufactured at lower costs, in particular by using cheaper types of glass and avoiding welded joints in and near the seal of the lamp vessel.

In agreement herewith the invention relates to a halogen incandescent lamp of the kind mentioned in the preamble which is characterized in that the lamp vessel consists of an alkali-alumino-borosilicate glass having a coefficient of expansion of $31 - 37 \times 10^{-7\circ} C^{-1}$ at 0° – 300° C, the internal current conductors each with a current leadthrough conductor and an external current conductor form a molybdenum wire having a minimum diameter of 400 μm and at least the part of each of the molybdenum wires which extends within the vacuum-tight seal of the lamp vessel is surrounded in a vacuum-tight manner by a glass bead of the kind of glass from which the material of the lamp vessel is selected, the ratio between the diameter of the molybdenum wires and the wall thickness of the glass bead being larger than 2 and the angles at which the glass of the lamp vessel contacts the glass of the bead, measured through glass, being at most 90°.

It has surprisingly proved possible to obtain a vacuum-tight seal of the current conductors of molybdenum wire in the glass of the lamp vessel which seal can withstand considerable temperature fluctuations. This is remarkable because the coefficient of expansion of molybdenum ($54 \times 10^{-7\circ} C^{-1}$) is much higher than that of the glasses which, due to their high softening temperature (≧ 500° C) and halogen resistivity, are to be considered for use as a material for the lamp vessel.

This is the more remarkable since in this case a temperature-resistent vacuum-tight connection is effected between glass and wires which - in contrast with the foils (thickness approximately 30 μm) used in seals in quartz glass and glass having an $SiO_2$ content of more than 96% — are relatively very thick, while in addition, in the case wires are used, no optimum use can be made of the ductility of molybdenum, which is the case indeed when foils are used.

Although it is known from German Patent Specification No. 884,073 that vacuum-tight connections of molybdenum wire with pyrex (trademark of Corning Glass Works) glass can be obtained by sliding a tube of said glass around the wire and then evacuating the tube and sealing with the metal, this results in a product having a rotationally symmetric geometry in which stresses in the material are equal in all directions of a cross-section.

In the lamp according to the invention a rotationally symmetric geometry around a sealed molybdenum wire is impossible. In this case at least three molybdenum wires are led through the seal of the lamp vessel. Not only does none of the wires have a rotationally symmetric seal, the geometry of the seal is in general not equal for each of the wires either.

In general the lamp vessel has a cylindrical shape with at one end a sealed-off exhaust tube and at the other end the vacuum-tight seal through which the molybdenum wires are lead. In the seal said wires will generally be situated in a flat plane. The geometry of the seal of the outermost wires is substantially equal, that of the innermost, however, is quite different.

It is just in lamps like those according to the invention in which the lamp construction experiences considerable temperature variations that it is endeavoured to obtain a maximum symmetric geometry so as to prevent material stresses which result in cracks and hence leakage of gas and the end of the life of the lamp.

In lamps according to the invention the lamp vessel during operation should have such a high temperature that tungsten-halogen compounds are volatile at the wall. In the case of an H-4 motorcar lamp the filaments according to the present prescriptions each consume a power of 55 to 60 Watts during operation at nominal voltage, while the lamps should be constructed so that both filaments can be in operation at the same time. For the lamps having an operating voltage of 6 Volts this implies a current passage of 20 A and upon igniting the lamp even more.

In spite of the asymmetric geometry of the wire seals and the high thermal load thereof, the lamps according to the invention have proved to be very reliable.

It was found that the angle at which the glass of the lamp vessel contacts the glass of the bead on the molybdenum wires is of importance for the life of the lamp vessel seal. Notably for the angle inside the lamp vessel ($\alpha$ in FIG. 2) a value which is as small as possible is of significance. Said angle is preferably 45° or smaller.

The length of the bead on the molybdenum wires is in practice chosen to be so that no rejects occur in the production in that non-enveloped parts of the wires become situated in the seal. As a rule, the bead will consequently extend to at least 1 mm beyond the seal.

The ratio between the diameter of a molybdenum wire and the wall thickness of the glass bead is larger than 2. If this ratio is made larger, smaller stresses in the seal occur. For technological reasons, however, the ratio in practice will as a rule be between 2 and 15.

Glasses consisting mainly of 77 - 81% by weight of $SiO_2$, 12 - 15% by weight of $B_2O_3$, 3 - 5.5% by weight of $Na_2O$ and 1.5 - 2.5% by weight of $Al_2O_3$ have proved to be particularly suitable as glass materials for the lamp vessel.

The glass bead on the molybdenum wires may also consist of this material. The bead may be provided by heating degased molybdenum wires, after sliding a glass tube on it, in a neutral or reducing gas atmosphere above the softening temperature of the glass.

Alternatively, the glass bead may be obtained by locally coating the molybdenum wires with a glass enamel.

Although it is to be preferred, it is not necessary for the surface of the enveloped wire parts to be free from oxide.

The molybdenum wires generally have a diameter of 600 to 800 μm so as to obtain a sufficient rigidity to be able to arrange the filaments in a vibration-free manner without the wires being supported against the wall of the lamp vessel. Although the diameter may be chosen to be larger, for example 1 mm, this gives no mechanical advantages as a rule.

The lamps according to the invention may be provided with a non-transparent screen to stop a part of the light irradiated by one of the filaments. This screen (dipping cap) may be provided on or near the wall of the lamp vessel but it is preferably situated between the molybdenum wires, secured to one of the wires.

The lamps preferably contain an oxygen getter although this is not always necessary, depending on the extent to which the lamp components and the glass filling are free from oxygen and water. As such may be mentioned inter alia zirconium, tantalum and niobium, and also phosphorus which may be provided in the lamp in one of the elementary modifications and also as a compound, for example, $P_3N_5$ or $WP_2$.

The lamp may be filled with an inert gas, for example, nitrogen, argon, krypton, xenon having a pressure up to a few atmospheres, for example, with 3 to 5 atmospheres of krypton. The gas atmosphere contains halogen or a halogen-containing compound. To be preferred is bromine as an active constituent, in particular hydrogen bromide as a bromine compound. This substance may be provided as such in the lamp, if desired together with hydrogen, or may be formed during the starting of the lamp from a bromine-containing and hydrogen-containing compound, for example $CH_2Br_2$ or $CH_3Br$. The partial pressure of hydrogen bromide as a rule is between 5 and 30 torr.

In order to facilitate the assembly of the lamp, the whole of molybdenum wires, filaments and possibly dipping cap and getter may be kept together and fixed by a glass beam connected to the molybdenum wires during making the seal of the lamp vessel.

Although the lamp vessel generally will have a cylindrical shape, the wall of the lamp vessel may locally be curved so as to prevent annoying reflections (see, for example, Netherlands Patent Application No. 7,014,336 laid open to the public inspection).

The invention will be described in greater detail with reference to the figures and the example.

Figure 1:
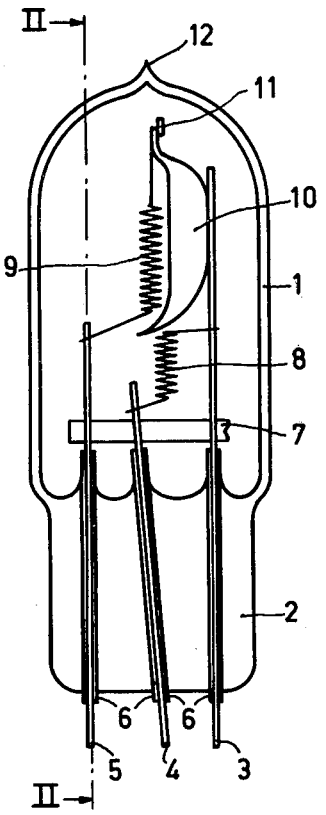
FIG. 1 is a longitudinal sectional view through a lamp according to the invention suitable for use as a motorcar lamp.

The lamp vessel 1 in FIG. 1 comprises a vacuum-tight seal 2 through which the molybdenum wirecurrent conductors 3, 4 and 5 are passed. These conductors comprise glass beads 6. Inside the lamp vessel a glass beam 7 connects the current conductors. A driving light filament 8 is stretched between the conductors 4 and 3, an anti-dazzle light filament 9 extends between the conductor 5 and the dipping cap 10 connected to conductor 3. The dipping cap has a getter 11. The tipped-off exhaust tube is referenced 12.

Figure 2:
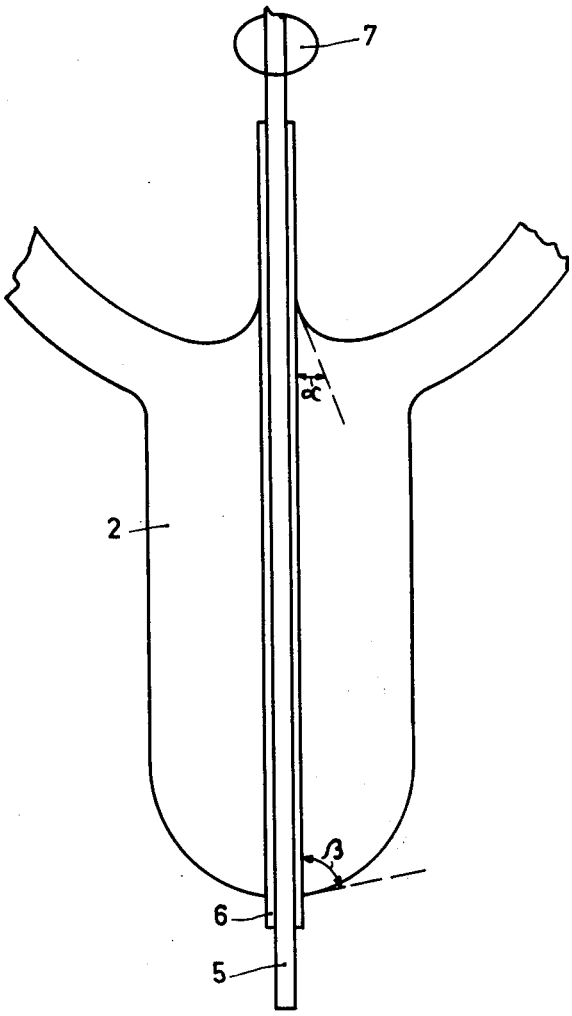
FIG. 2 is a sectional view through the seal of the lamp vessel perpendicular to the plane of the drawing of FIG. 1.

In FIG. 2 the same reference numerals are used as in FIG. 1. The angles $\alpha$ and $\beta$ shown in the drawing explain the expression "the angle at which the glass of the lamp vessel contacts the glass of the bead, measured through glass", wherein $\alpha$ is the "angle inside the lamp vessel".

EXAMPLE 1

Molybdenum wires 3, 4 and 5 (FIG. 1) of 600 μm diameter were secured in a quartz glass beam 7 and then degased at 100° C in a reducing atmosphere (90% by volume of $N_2$, 10% by volume of $H_2$). Glass capillaries 6 (inside diameter 620 μm, outside diameter 800 μm) were slid on the wires after which the glass was sealed around the wires in a reducing atmosphere at 1000° C. A molybdenum dipping cap 10 was provided with a piece of tantalum foil (2 × 1 mm) and welded to the conductor 3. The filaments 8 and 9 were then provided. The assembly was provided in a cylindrical lamp vessel 1 of which the glass, as well as that of the capillaries, consisted mainly of 80.5% by weight of $SiO_2$, 13% by weight of $B_2O_3$, 3.5% by weight of $Na_2O$, 0.7% by weight of $K_2O$ and 2.3% by weight of $Al_2O_3$, which glass is commercially available as "Pyrex". The lamp vessel had an outside diameter of 18 mm, a wall thickness of 1.3 mm and a length of 45 mm, was substantially spherical at one end and at that area had an exhaust tube.

While a protective gas, 90% by volume of $N_2$, 10% by volume of $H_2$, was led through via the exhaust tube, the open end of the lamp vessel was heated to above the softening point of the glass, the glass of the lamp vessel fusing with the glass of the bead on the molybdenum wires. The glass was then shaped by means of pinching blocks.

The bead 6 on the molybdenum wires extended at one end to approximately 1 mm beyond the lamp vessel, at the other end up to the quartz glass beam 7.

The lamp vessel was then evacuated via the exhaust tube, filled with 5 atmosphere krypton and 5 torr, $CH_2Br_2$ (pressures at 20° C) after which the exhaust tube was tipped off.

EXAMPLE 2

A similar lamp was made with the difference that the molybdenum wires were locally covered with a suspension of a powder mainly consisting of 80.3% by weight of $SiO_2$, 12.9% by weight of $B_2O_3$, 3.7% by weight of $Na_2O$, 0.8% by weight of $K_2O$ and 2.3% by weight of $Al_2O_3$ in ethanol. The suspension was dried after which the residue was melted in a nitrogen/hydrogen mixture (9:1).

What is claimed is:

1. A halogen incandescent lamp which comprises: a lamp vessel of a high-melting-point transparent material which is resistant to halogen, at least three molybdonum internal current conductors disposed in said vessel, at least two tungsten filaments stretched between said internal current conductors, said lamp vessel comprising a vacuum-tight seal having a plurality of current leadthrough conductors incorporated therein which are each in electrical contact with one of said internal current conductors, a plurality of external current conductors extending outside said lamp vessel, each of said external current conductors being connected to one of said leadthrough conductors, said lamp vessel being filled with a halogen-containing inert gas, said lamp vessel consisting of an alkali-alumino-borosilicate glass having a coefficient of expansion of $31 - 37 \times 10^{-7}$° $C^{-1}$ at 0°-300° C, said internal current conductors being a molybdenum wire having a minimum diameter of 400 microns, a glass bead of the kind of glass from which the material of the lamp vessel is selected being disposed in surrounding vacuum tight relationship to at least the part of each of said molybdenum wires which extend in said vacuum-tight seal of said lamp, the ratio between the diameter of the molybdenum wires and the wall thickness of the glass bead being larger than 2 and the angles at which the glass of the lamp vessel contacts the glass of the bead, measured through glass, being at most 90°.

2. A halogen incandescent lamp as claimed in claim 1, said glass of said lamp vessel mainly consists of 77-81% by weight of $SiO_2$, 12-15% by weight of $B_2O_3$, 3-5.5% by weight of $Na_2O$ and 1.5-2.5% by weight of $Al_2O_3$.

3. A halogen incandescent lamp as claimed in claim 2 wherein the ratio between the diameter of said molybdenum wires and the wall thickness of the glass bead disposed in surrounding relationship is between 2 and 15.

4. A halogen incandescent lamp as claimed in claim 2 wherein the angle $\alpha$ at which the glass of the lamp vessel contacts the glass of the bead on the molybdenum wires inside the lamp vessel is at most 45°.

5. A halogen incandescent lamp as claimed in claim 1 wherein said molybdenum wires have a diameter of 600 to 800 microns.

* * * * *